United States Patent [19]

Munson

[11] Patent Number: 4,559,479

[45] Date of Patent: Dec. 17, 1985

[54] STARTING AND DIMMING CIRCUIT FOR FLUORESCENT LAMPS

[75] Inventor: Robert D. Munson, Tupelo, Miss.

[73] Assignee: Emerson Electric Co., St. Louis, Mo.

[21] Appl. No.: 594,332

[22] Filed: Mar. 28, 1984

Related U.S. Application Data

[63] Continuation-in-part of Ser. No. 506,084, Jun. 20, 1983, abandoned.

[51] Int. Cl.[4] ..... H05B 37/00

[52] U.S. Cl. ..... 315/239; 315/105; 315/240; 315/DIG. 4

[58] Field of Search ..... 315/DIG. 4, 240, 239, 315/105

[56] References Cited

U.S. PATENT DOCUMENTS

| | | | |
|---|---|---|---|
| 3,274,484 | 9/1966 | Gebhardt et al. | 315/240 |
| 3,323,013 | 5/1967 | Lord | 315/DIG. 4 |
| 3,911,320 | 10/1975 | Crawford | 315/240 |
| 4,348,612 | 9/1982 | Morton | 315/58 |

FOREIGN PATENT DOCUMENTS

| | | |
|---|---|---|
| 1224837 | 9/1966 | Fed. Rep. of Germany . |
| 397000 | 8/1933 | United Kingdom . |

*Primary Examiner*—Harold Dixon

*Attorney, Agent, or Firm*—Charles E. Markham

[57] ABSTRACT

A rapid start circuit for starting and step dimming a fluorescent lamp includes a voltage step up auto transformer and lamp filaments for starting, ballast and a pair of capacitors having different values variously connected in series with the lamp and ballast by a rotary switch; first in parallel, then individually and then in series to achieve a progressively stepped dimming of the lamp. A second form of the invention includes a first capacitor in series with the lamp and ballast for reducing the maximum light output of the lamp and a plurality of capacitors each having a different value selectively connected in parallel with the first capacitor by a slide switch to selectively dim the lamp; and a resistor in series with the first capacitor to diminish arcing and noise when switching. Both forms of the invention include a pair of secondary windings for maintaining filament voltage.

3 Claims, 5 Drawing Figures

Figures 1, 2, 3, 4, 5:
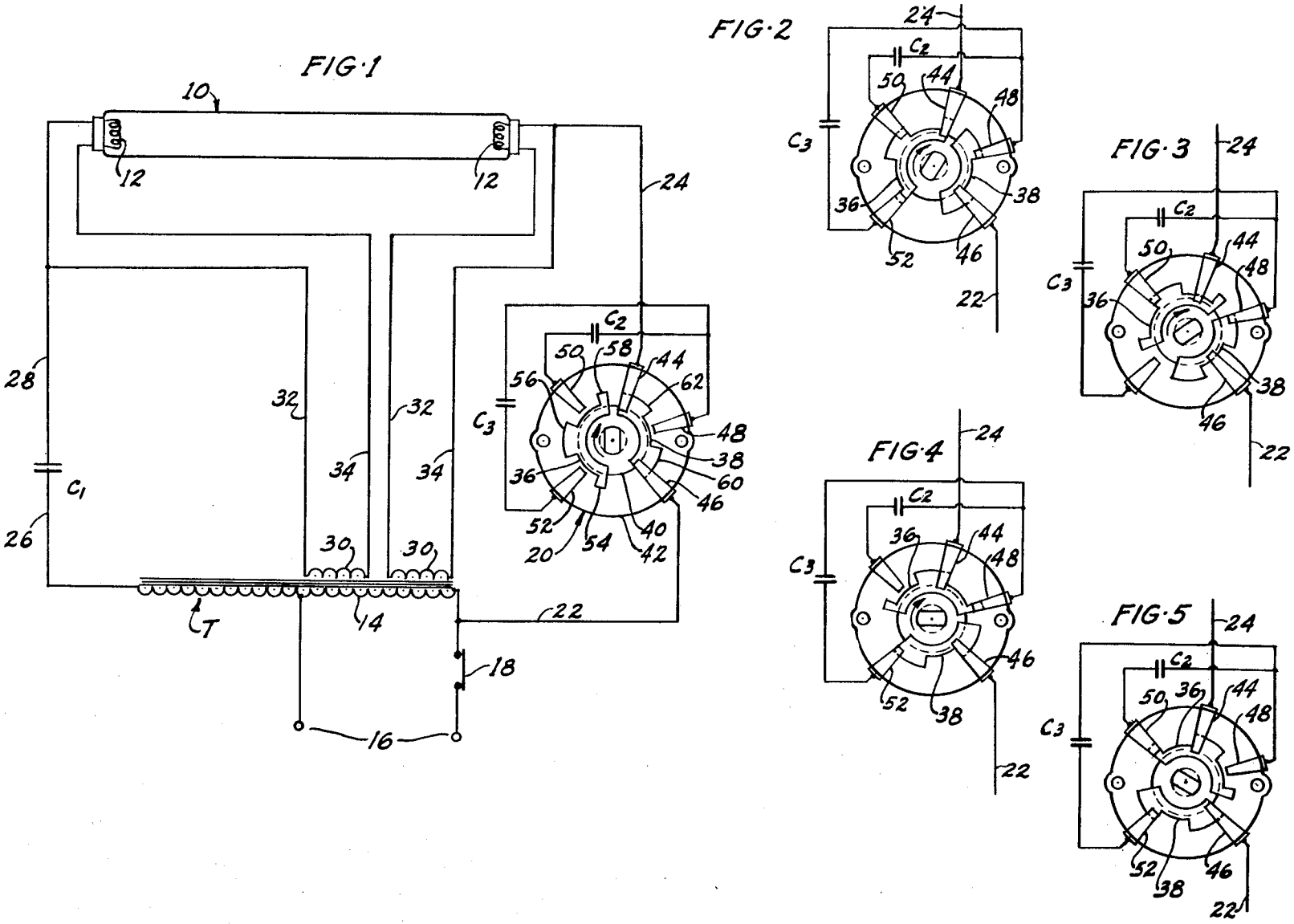

10
12
14
16
18
20
22
24
26
28
30
32
34
36
38
40
42
44
46
48
50
52
54
56
58
60
62
C1
C2
C3
T

STARTING AND DIMMING CIRCUIT FOR FLUORESCENT LAMPS

This application is a continuation in part of application 06/506,084 for DIMMING CIRCUIT FOR FLUORESCENT LAMPS, filed June 20, 1983 now abandoned.

This invention relates to circuits for starting and dimming fluorescent lamps and particularly to an improved rapid start circuit wherein current flow through the lamp is variously impeded to effect dimming while voltage applied to filaments at each end of the lamp remains substantially constant.

BACKGROUND OF THE INVENTION

There is a need for a simple, low cost and energy efficient dimming circuit for a single conventional double end fluorescent lamp when employed to illuminate the work areas of modern office furniture such as desks or drawing boards. Presently available dimming circuits therefor are relatively expensive and in most cases the power imput does not decrease in proportion to the decrease in light level. I have found that a commercially available, rapid start type two lamp ballast sells for the same price as a single lamp ballast of the same type and provides the two independent secondary windings necessary to maintain a constant filament voltage at both ends of a single fluorescent lamp to insure conduction when current through the lamp is substantially reduced by impedence for the purpose of dimming light output.

I have also found that objectionable arcing and noise incidental to switching an uncharged capacitor in parallel with a charged capacitor may be dramatically minimized by placing a low ohmic resistor in series with the charged capacitor.

In a first form of the invention wherein economical employment of capacitors to effect dimming is a feature, two capacitors of different value are progressively connected in series with the lamp and ballast by a rotary switch, first in parallel with each other, second and third individually and fourth in series with each other so as to progressively reduce current flow through the lamp thereby to progressively dim the lamp in four steps.

In a second form of the invention a first capacitor is connected in series with the lamp and ballast to further limit the maximum light output of the lamp in accordance with the relative positions of the lamp and a work area and in accordance with a calibrated task light lens so as to provide a desirable maximum illumination of the work area. Additionally four capacitors having progressively less capacitance are selectively connected in parallel with the first capacitor by a four position slide switch to selectively establish with the first capacitor a maximum light output and to further reduce or dim the light output below this maximum. A resistor is connected in series with the first capacitor to substantially eliminate arcing and noise incidental to the connection of any of the four uncharged capacitors with the first charged capacitor. In both first and second forms of the invention the ballast and starting circuit includes a step up auto transformer and in both forms sufficient voltage across the lamp filaments at the ends of the lamp is supplied by separate secondary windings of the transformer to insure maintenance of conduction when current flow through the lamp is substantially reduced to effect dimming.

OBJECTS OF THE INVENTION

An object of the invention is to provide a generally new and improved rapid start circuit for fluorescent lamps including impedance means for selectively reducing the current flow through the lamp to effect a selective reduction in light level while maintaining substantially constant voltage across the lamp filaments thereby to maintain cathode emission at substantially reduced current flow through the lamp.

A further object is to connect a plurality of capacitors having different values into a fluorescent lamp circuit by rotary switch means in a manner to progressively reduce current flow through the lamp as the rotary switch is rotated in one direction.

A further object is to selectively connect by switching means a pair of capacitors having different values in series with a fluorescent lamp and its ballast either individually, in parallel with each other or in series with each other to effect four stages of impedance to current flow through the lamp.

A further object is to provide a relatively low ohmic resistor connected in series with a charged capacitor to mitigate arcing and attendant noise when switching an uncharged capacitor in parallel therewith.

IN THE DRAWINGS

FIG. 1 diagrammatically illustrates a fluorescent lamp having a rapid start ballast and a first form of dimming circuit constructed in accordance with the present invention;

FIGS. 2 to 5 diagrammatically illustrates four successive rotational positions of the rotary switch wherein two capacitors of different value are progressively connected in series with the fluorescent lamp and ballast in a manner to progressively reduce light output.

Figure 6:
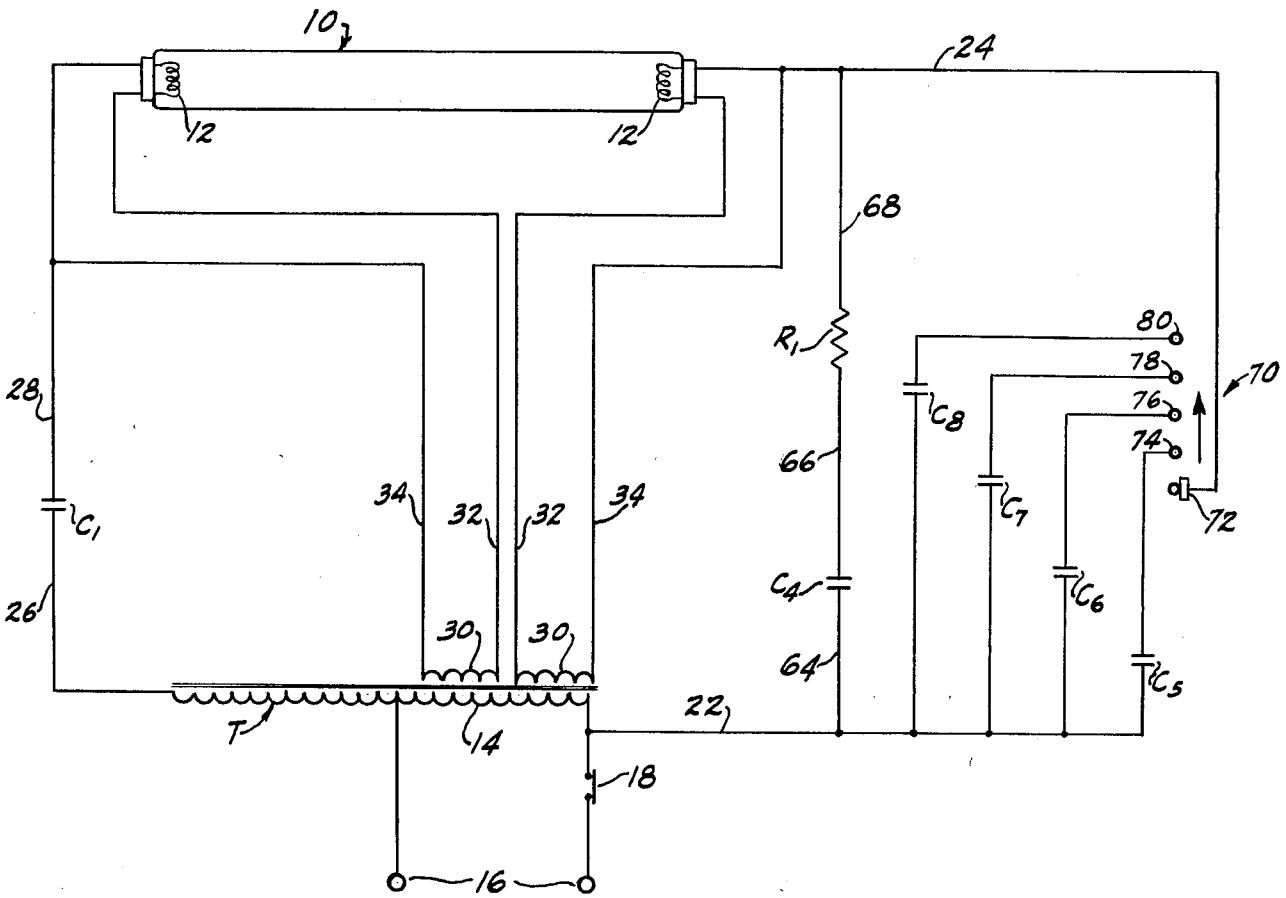

FIG. 6 diagrammatically illustrates impedance means for limiting the maximum output of a fluorescent lamp in a second form of dimming circuit constructed in accordance with the invention.

DESCRIPTION OF A FIRST FORM OF THE INVENTION SHOWN IN FIGS. 1 TO 5

Referring to FIG. 1 of the drawings a conventional elongated double end fluorescent lamp is generally indicated at 10. The lamp 10 has a discharge sustaining filling of mercury and an emitting filament 12 at both ends thereof. The lamp may also contain an ionizable gas.

Voltage for starting discharge is supplied by a voltage step up auto transformer T having a portion of its winding 14 connected to the terminals 16 of an AC power source through a line switch 18. One end of lamp 10 is connected to one end of transformer T through a rotary switch generally indicated at 20 by leads 22 and 24 and the other end thereof is connected to the other end of transformer T through a capacitor $C_1$ by leads 26 and 28. The lamp filaments 12 are each connected across independent secondary windings 30 of transformer T by leads 32 and 34. Ballast to limit and steady current flow through the lamp to that which will result in an optimum high luminosity level when discharge is started is provided by inductance of the transformer windings and the capacitor $C_1$.

Additional impedance in the form of a pair of capacitors variously connected in the lamp circuit by rotary switch means to reduce by steps the current flow through the lamp in order to dim by steps the light output will now be described. The rotary switch 20 has two separated arcuate conductor plates 36 and 38 which are suitably fixed on a circular dielectric disc 40. The disc 40 is rotatably mounted in a circular aperture formed in a larger circular dielectric disc 42. The rotary switch 20 further includes suitable indexing means (not shown) for indexing disc 40 and the attached conductor plates 36 and 38 in the various angular positions shown in FIGS. 1 to 5.

There are five contactor elements arranged around and fixed on the periphery of larger disc 42 and are arranged to contact the arcuate plates as they are rotated thereunder. Two of these contactor elements designated 44 and 46 are longer than the other three and extend radially inward and contact any part of either of arcuate contactor plates 36 and 38 when rotated to a position thereunder. The remaining three contactor elements designated 48, 50 and 52 are shorter and contact only the radially outward extending lobes on the contactor plates. There are three such radially extending lobes on arcuate contactor plate 36 which are designated 54, 56 and 58 and there are two such radially extending lobes on arcuate contactor plate 38 which are designated 60 and 62. The longer contactor elements 44 and 46 are connected to leads 24 and 22 respectively.

When rotary switch 20 is in the position shown in FIG. 1 the leads 24 and 22 connecting the right end of transformer T to the right hand side of the lamp are connected respectively through contactor elements 44 and 46 and the arcuate contactor plate 38. When in this position there is no additional impedance introduced into the lamp circuit and the lamp is at its highest luminous level. When the disc 40 and the attached contactor plates 36 and 38 are rotated clockwise, in the direction of the arrow, to an indexed position shown in FIG. 2, the shorter contactor elements 50 and 52 and longer contactor element 44 are in contact with arcuate plate 36 and shorter contactor element 48 and longer contactor element 46 are in contact with arcuate plate 38. When in this position, as shown in FIG. 2, a capacitor $C_2$ and a capacitor $C_3$ are connected in parallel across the leads 22 and 24 thereby connecting a first degree of impedance into the lamp circuit.

When disc 40 and attached arcuate connector plates 36 and 38 are rotated further in the same direction to the indexed position shown in FIG. 3 the contactor elements 44 and 50 are in contact with arcuate plate 36 and contactor elements 48 and 46 are in contact with arcuate plate 38. When in this position the capacitor $C_2$ is connected alone across the leads 22 and 24. Capacitor $C_2$ has greater capacitance than capacitor $C_3$.

When disc 40 and the attached arcuate connector plates 36 and 38 are rotated further in the same direction to an indexed position shown in FIG. 4, the contactor elements 44 and 48 are in contact with arcuate plate 36 and contactor elements 46 and 52 are in contact with arcuate plate 38. When in this position capacitor $C_3$ is connected alone across leads 22 and 24. Capacitor $C_3$ has lesser capacitance than capacitor $C_2$.

When disc 40 and attached arcuate plates 36 and 38 are rotated still farther in the same direction to an indexed position as shown in FIG. 5, the contactor elements 50 and 44 are in contact with arcuate plate 36 and contactor elements 46 and 52 are in contact with arcuate plate 38. In this position it will be seen that capacitors $C_2$ and $C_3$ are connected in series across leads 22 and 24 thereby introducing the greatest value of impedance to current flow through lamp 10 and thereby causing the light output thereof to be at its lowest level.

A resistor $R_1$ is connected in series with capacitor $C_2$ thereby to minimize any arcing or noise which may occur when connecting a charged capacitor $C_2$ in parallel with uncharged capacitor $C_3$. This may occur when rotating the rotary switch 20 in a counterclockwise direction from the position shown in FIG. 3 to the position shown in FIG. 2.

DESCRIPTION OF A SECOND FORM OF THE INVENTION SHOWN IN FIG. 6

Referring to FIG. 6 of the drawings in which like numerals indicate like elements, a capacitor $C_4$ and a resistor $R_1$ are connected in series with each other and in series with lamp 10 by leads 64, 66 and 68. Arranged for selective parallel connection with capacitor $C_4$ and resistor $R_1$ by a multi-position slide switch 70 are capacitors $C_5$, $C_6$, $C_7$ and $C_8$. The capacitors $C_5$ to $C_8$ have sequentially less capacitance thereby to sequentially add greater impedance to current flow through lamp 10 as movable contact 72 of the slide switch 70 is moved successively into contact with stationary contacts 74, 76, 78 and 80.

Inasmuch as capacitor $C_4$ is charged and discharged every cycle of the AC power supply when line switch 18 is closed and the lamp conducting, the switching of any of the uncharged capacitors $C_5$ to $C_8$ at an instant when capacitor $C_4$ is substantially charged may result in objectionable arcing and noise without resistor $R_1$ in series therewith. As has been previously stated applicant has found that a resistor of relatively low resistance connected in series with capacitor $C_4$ will substantially mitigate this objectionable arcing and noise. An inductor may be substituted for resistor $R_1$ but the resistor is more economical.

A purpose of providing an additional impedance in the form of capacitor $C_4$ is to reduce the maximum current flow through the lamp and therefore its maximum light output as limited by the usual ballast is to permit placing the lamp relatively close to a work area which it is to illuminate. Also, when lamp 10 is employed in a task light which includes a calibrated light distribution lens calibrated to provide uniform illumination of an underlying work area when positioned a finite and relatively short distance therefrom, the provision of means for reducing the maximum light output in accordance with the finite distance is desirable.

However, in installations wherein a reduction in maximum light output of the lamp as determined by the usual ballast, as when the lamp is mounted a sufficient distance from a work area, the capacitor $C_4$ and resistor $R_1$ and connecting leads may be omitted. In installations wherein capacitor $C_4$ and resistor $R_1$ are omitted the capacitors $C_5$ to $C_8$ may be selectively connected directly in series with lamp 10 by slide switch 70 and their values modified in order to selectively dim the lamp 10 as desired.

It will be understood that the foregoing described starting and dimming circuits may be employed to start and dim multiple series connected lamps of the kind described provided that sufficient voltage is maintained across the filaments thereof to maintain discharge when current flow through the lamp is substantially reduced.

I claim:

1. Starting and dimming circuitry for a double ended fluorescent lamp having a discharge sustaining fill of mercury and an emitting filament at each end; comprising an AC power source, a first circuit means for applying a voltage across said lamp including said lamp and the secondary winding of a voltage step-up transformer having it primary winding connected across said power source, and a second circuit means for simultaneously applying a voltage across said filaments thereby to start lamp discharge, said second circuit means including separate secondary windings of said transformer each being connected in series with one of said filaments, said first circuit means further including impedance means for limiting current flow through said lamp, and means for selectively introducing additional impedances into said first circuit to selectively further limit current flow through said lamp, said means for selectively introducing additional impedance means into said first circuit means comprising two capacitors having different values, circuit connections and switching means for selectively connecting said two capacitors in series with said lamp either in parallel with each other, in series with each other or individually.

2. Starting and dimming circuitry for a double end fluorescent lamp having an emitting filament at each end; comprising an AC power source, a first circuit means for applying a starting voltage across said lamp including said lamp and the secondary winding of a voltage step-up transformer having its primary winding connected across said power source, and a second circuit means for simultaneously applying a voltage across said filaments, said second circuit means including separate secondary windings of said transformer each being connected in series with one of said filaments, said first circuit means including a first impedance means for limiting current flow through said lamp after starting, and means for further limiting current flow through said lamp to a maximum below that limitation effected by said first impedance means and for selectively reducing current flow through said lamp below said maximum comprising a first capacitor in said first circuit connected in series with said lamp and said first impedance means, a plurality of disconnected capacitors having different values, circuit connections and switching means for selectively connecting each of said plurality of disconnected capacitors in parallel with said first capacitor.

3. The starting and dimming circuitry claimed in claim 2 in which a relatively low ohmic resistor is connected in series with and adjacent to said first capacitor for subduing arcing when said first resistor is connected in parallel with one of said plurality of capacitors.

* * * * *